United States Patent [19]

van der Ven

[11] Patent Number: 4,551,651

[45] Date of Patent: Nov. 5, 1985

[54] COLOR DISPLAY TUBE INCLUDING A SHADOW MASK SHEET WITH A BULGED PORTION

[75] Inventor: Robert F. L. M. van der Ven, Eindhoven, Netherlands

[73] Assignee: U.S. Philips Corporation, New York, N.Y.

[21] Appl. No.: 642,745

[22] Filed: Aug. 20, 1984

Related U.S. Application Data

[63] Continuation of Ser. No. 536,227, Sep. 27, 1983, abandoned, which is a continuation of Ser. No. 270,446, Jun. 4, 1981, abandoned.

[30] Foreign Application Priority Data

Jun. 23, 1980 [NL] Netherlands ..... 8003608

[51] Int. Cl.[4] ..... H01J 29/02; H01J 29/07

[52] U.S. Cl. ..... 313/402; 313/404

[58] Field of Search ..... 313/402–408

[56] References Cited

U.S. PATENT DOCUMENTS 3,935,496 1/1976 Gijrath ..... 313/402

4,191,909 3/1980 Dougherty ..... 313/402

*Primary Examiner*—Palmer C. DeMeo

*Assistant Examiner*—Sandra L. O'Shea

*Attorney, Agent, or Firm*—Robert J. Kraus

[57] ABSTRACT

A shadow mask (20) for a color display tube is formed from one piece. Each side of the shadow mask (20) comprises a bulged portion (23) with a collar (24). Having a center of mass which when viewed in a cross-section perpendicular to the side, is situated substantially in the plane of the shadow mask sheet (21). As a result of this no moments are exerted on the shadow mask (20) when vibrations and shocks occur, so that the mask is not deformed. The angle which the collars (24) make with the longitudinal axis of the display tube is such that electrons reflected at a collar (24) do not land within the pattern of apertures (22) on the shadow mask (20). A magnetic screening cap adapted to the shadow mask construction is also constructed so that electrons reflected at the cap do not land within the pattern of apertures (22) of the shadow mask (20).

9 Claims, 14 Drawing Figures

COLOR DISPLAY TUBE INCLUDING A SHADOW MASK SHEET WITH A BULGED PORTION

This is a continuation of application Ser. No. 536,227 filed Sept. 27, 1983, which was a continuation of Ser. No. 270,446 filed June 4, 1981, both now abandoned.

BACKGROUND OF THE INVENTION

The invention relates to a colour dispay tube comprising an envelope having an electron gun system to generate a number of electron beams and a substantially rectangular display window comprising an upright edge and a substantially rectangular shadow mask sheet provided with a pattern of apertures and connected in the corners of the upright edge of the display window.

Such a colour display tube is disclosed in U.S. Pat. No. 3,548,235. In this patent the shadow mask does not comprise the usual rigid carrier frame. The shadow mask is formed by a substantially rectangular mask sheet manufactured from thin metal plate and having a mask ring of substantially the same thickness as the mask sheet connected to the edge. The free end of the mask ring is bent over and gives the shadow mask a certain rigidity at the sides of the shadow mask. The shadow mask is connected to the four corners of the upright edge of the display window. However, the shape of the mask ring causes moments to be exerted on the mask sheet in the case of vibrations and shocks of the tube. These moments produce deformation of the shadaw mask which causes fading of the displayed picture. Moreover, welding of the mask ring to the mask sheet is expensive and welding sputters may land on the shadow mask sheet.

SUMMARY OF THE INVENTION

It is therefore an object of the invention to provide a colour display tube in which the shadow mask is of a simple construction, is manufactured from the smallest possible number of components, has a large resistance against shocks and vibrations and does not substantially deform as a result of thermal effects.

It is another object of the invention to provide a screening cap which is adapted to the new shadow mask construction and which is used to screen the electron beams from the earth's magnetic field.

For that purpose, a colour display tube of a kind mentioned in the opening paragraph is characterized in that the each side of the shadow mask sheet comprises a bulged portion thereof extending toward the display window and including a collar extending away from the display window. The centre of mass of the bulged portion at any cross-section taken perpendicularly to the longitudinal direction of the portion is situated substantially in the plane of the pattern of apertures.

In a display tube in accordance with the invention the shadow mask is manufactured from one sheet. The shadow mask is rigid in its own plane. The bulged portions with collars give the sides of the shadow mask, and hence the entire mask a certain rigidity perpendicular to the plane of the shadow mask. Since the centre of mass of a cross-section of the bulged portion in a direction perpendicular to the longitudinal direction of the portion is situated substantially in the plane of the mask sheet, no moments are exerted on the mask sheet in the case of the occurrence of shocks and vibrations, so that the mask sheet remains undeformed. As a matter of fact the occurring forces lie in the plane of the mask sheet which is rigid in its own plane and are transmitted to the bulged portions where the forces act in the centres of mass of the portions.

It is to be noted that a shadow mask having a peripheral embossment extending toward the display window is known per se from U.S. Pat. No. 3,005,921. In this case, however, it concerns a post-acceleration tube having a circular shadow mask in which the peripheral embossment serves to counteract interferences of the post-accelerating field at the edge of the shadow mask.

An embodiment of a display tube in accordance with the invention is characterized in that the collar makes such an angle with the longitudinal axis of the display tube that electrons reflected by the collar fall on the mask sheet outside the pattern of apertures. As a result of this there is no need for a diaphragm, which in conventional shadow mask display tubes is connected to the upright edge of the mask sheet to prevent electrons reflected at the upright edge from landing on the mask within the pattern of apertures. Moreover, the omission of the diaphragm has the advantage that electrons land on the whole mask so that the mask is more uniformly warmed-up.

Another embodiment of the display tube is characterized in that the collar makes such an angle with the longitudinal axis of the display tube that electrons reflected by the collar are reflected in a direction which is at least perpendicular to the longitudinal axis of the tube, so that the electrons reflected at the collar do not land on the mask sheet. In this embodiment also no diaphragm is necessary since the electrons reflected by the collar do not land on the mask sheet.

Another embodiment of a display tube is characterized in that the tube comprises an internal conical magnetic screening cap which on its side facing the display window overlaps the collar of the shadow mask and extends substantially parallel to the collar. The screening cap serves to screen the electron beams from the earth's magnetic field. As a result of the overlap of the screenig cap and the collar of the shadow mask the screening cap and the shadow mask are short-circuited magnetically without the two components necessarily making mechanical contact with each other.

Another embodiment is characterized in that the overlap of the screening cap and the collar of the shadown mask is at least ten times as large as the distance between the screening cap and the collar. It has been found experimentally that good magnetic screening is obtained in this case.

Another embodiment of a display tube in accordance with the invention in which the collar makes such an angle with the longitudinal axis of the display tube that electrons reflected by the collar fall on the mask sheet outside the pattern of apertures is characterized in that the portion of the screening cap near the collar of the shadow mask comprises a shoulder which covers the aperture between the screening cap and the shadow mask. The shoulder prevents electrons between the screening cap and the collar of the shadow mask from landing on the display window via reflections.

Another embodiment of a display tube in accordance with the invention in which the collar makes such an angle with the longitudinal axis of the display tube that electrons reflected by the collar fall on the mask sheet outside the pattern of apertures is characterized in that the magnetic screening cap, in a cross-section along a plane through the longitudinal axis of the display tube, has the form of a part of an ellipse of which one focus lies in the mask sheet just outside the pattern of apertures and the other focus lies in the deflection point of the electron beam which in the direction of the edge of the pattern of apertures makes the largest angle with the longitudinal axis of the tube. The magnetic screening cap should have a shape which ensures that electrons reflected by the screening cap land on the shadow mask outside the pattern of apertures. This situation can be most effectively accomplished if the screening cap has the form of an ellipse which is rotated about the focus lying just outside the pattern of apertures in a direction towards the longitudinal axis of the display tube or if the screening cap has the form of an ellipse which is moved in a direction away from the longitudinal axis of the display tube. The impinging electrons having the largest angle of incidence will then land on the shadow mask at a larger distance outside the pattern of apertures.

BRIEF DESCRIPTION OF THE DRAWING

The invention will be described in greater detail with reference to the accompanying drawing, of which

DESCRIPTION OF THE PREFERRED EMBODIMENTS

Figure 1:
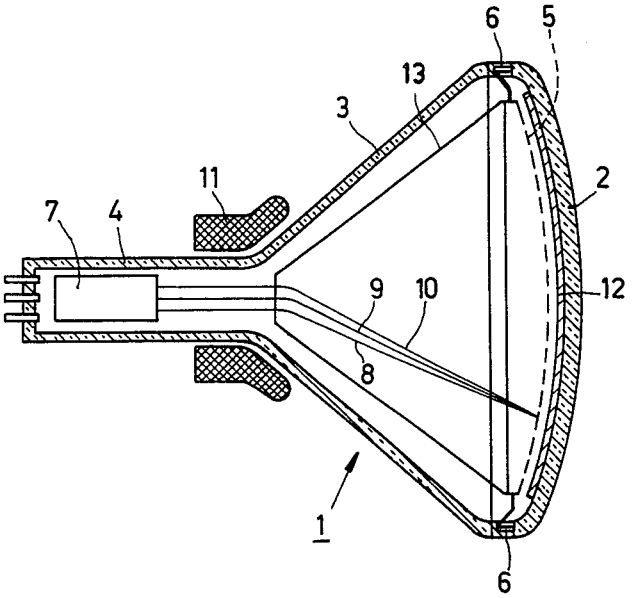
FIG. 1 is a sectional view of a colour display tube of the invention.

The colour display tube according to the invention shown in FIG. 1 is formed by a glass envelope 1 which comprises a substantially rectangular display window 2 which has an upright edge, a cone 3 and a neck 4. A pattern 12 of phosphors luminescing in the colours red, green and blue is provided on the display window 2. At a short distance in front of the display screen a shadow mask 5 is connected with the aid of suspension means 6. An electron gun 7 to generate three electron beams 8, 9 and 10 is mounted in the neck 4 of the tube. These beams are deflected by means of a system of deflection coils 11 placed around the tube. The beams intersect each other substantially at the area of the shadow mask 5, after which each of the electron beams impinges on one of the three phosphors provided on the display screen. The electron beams 8, 9 and 10 are screened in the tube from the earth's magnetic field by means of a magnetic screening cap 13.

Figure 2A:
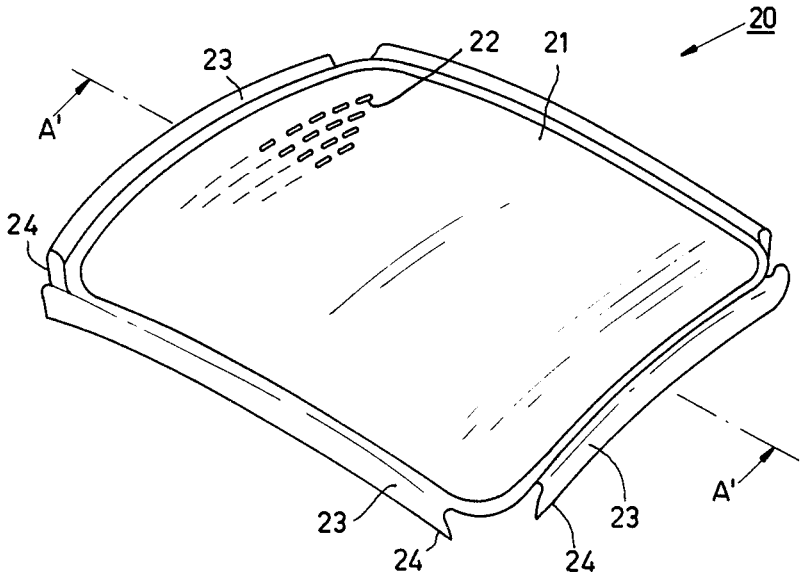
FIG. 2*a* is a perspective view of the shadow mask of the display tube shown in FIG. 1.

FIG. 2*a* is a perspective view of an embodiment of a shadow mask of the tube shown in FIG. 1. The shadow mask 20 is formed from a thin metal plate the central portion 21 of which has a large number of apertures 22. The shadow mask 20 is dished and corresponds with the shape of the display window. A bulged portion 23 terminating in a collar 24 is provided in each of the four rectangular sides of the mask 20. The collars 24 are bent inwardly and make an angle of 5° with the longitudinal axis 28 of the display tube.

Figure 2B:
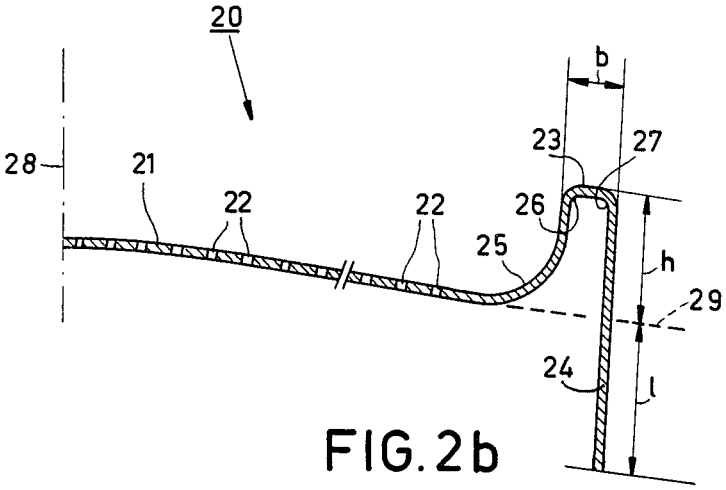
FIG. 2*b* is a sectional view along a part of the line A'A' of FIG. 2*a*.

FIG. 2*b* is a sectional view along a part of the line A'A' of FIG. 2*a*. The shadow mask 20 having apertures 22 comprises a bulged portion 23 of height h and width b and a collar 24 of length l. The length l of the collar 24 should be selected relative to the height h and the width b of the bulged portion 23 such that the centre of mass of a cross-section of the bulged portion 23 and collar 24 taken perpendicular to the longitudinal direction of the bulged portion is situated substantially in the plane of the mask sheet 21 as is shown by the broken line 29. As a result of this, no moments are exerted on the mask 20 when vibrations and shocks occur in the plane of direction of the mask 20. The occurring forces lie in the plane of the mask sheet which is rigid in its own plane and are transmitted to the bulged portion 23 with collar 24. As a result of these forces the bulged portion 23 with collar 24 may not experience a moment causing rotation since in that case the mask sheet is deformed and fading of the displayed picture occurs. These moments are prevented because the centre of mass of any cross-section of the bulged portion 23 with collar 24 perpendicular to the longitudinal direction of the bulged portion 23 with collar 24 is situated substantially in the plane of the mask sheet 21 and the center of mass is where applied forces are opertive.

The shadow mask 20 is manufactured, for example, from iron and has a thickness of approximately 0.15 mm. With a bulged portion 23 of height h=5 mm and width b=2.5 mm, the length l of the collar 24 should be substantially equal to l=8.6 mm in order that the centre of mass of a cross-section of the bulged portion 23 with collar 24 be situated substantially in the plane of the mask sheet 21.

For collars 24 which are bent inwardly it has been found that the maximum deflection angle in a direction along the line A'A' is decisive of the angle which the collar 24 should make with the longitudinal axis 28 of the display tube in order to prevent electrons which reflect at the collar 24 from landing within the pattern of apertures 22 of the mask 20. In the embodiment shown of a 110° display tube the maximum deflection angle of the electron beams which impinge on the end of the collar along the line A'A' is 51.5°. The outermost mask aperture 22 is situated at a distance of substantially 11 mm from the outside of the bulged portion 23. The collar 24 makes an angle of 5° with the longitudinal axis 28 of the display tube. Angles exceeding 5° are also possible, which will be explained in detail with reference to FIG. 2*c*. The electrons reflected at the collar 24 do land on the mask 20 so that the whole surface of the mask 20 is impinged upon by electrons which results in a more uniform warming-up of the mask 20. The radii of the curvatures 25, 26 and 27 are equal to 3.5 mm and 0.5 mm, respectively. By choosing the radii to be equal to these measurements and using a mask material having a tensile strength of $\sigma_B = 170^N/mm^2$ it has been found that the bulged portion 23 after drawing the shadow mask 20 deforms elastically in such manner that the collar 24 makes an angle of 5° with the longitudinal axis 28 of the display tube. By choosing the radii of the curvatures and/or the tensile strength of the mask material to be different, larger angles can be obtained in the same manner.

Figure 2C:
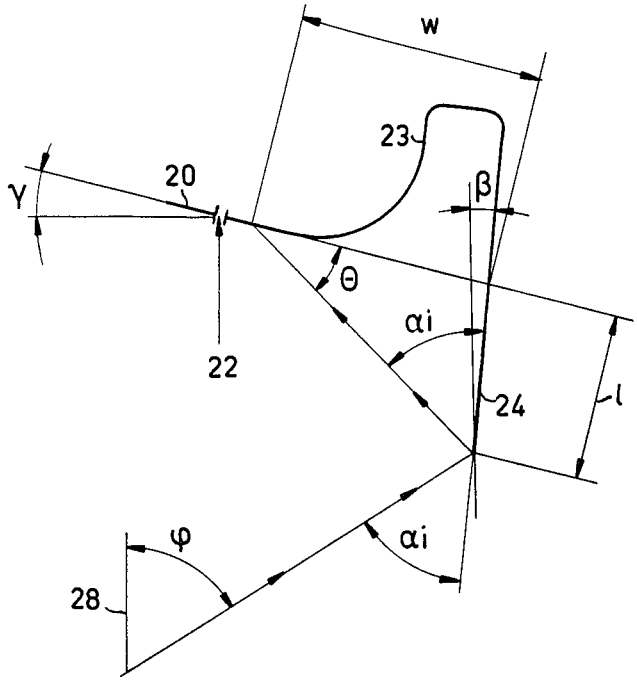
FIG. 2*c* shows shows schematically the form of the shadow mask of FIG. 2*a*, FIGS. 3*a*, 3*b* and 3*c* show the construction of the magnetic screening cap for the mask shown in FIG. 2*a*.

It will be described with reference to FIG. 2*c* which angle the collar should make with the longitudinal axis of the display tube in accordance with the various parameters in the display tube so as to prevent electrons reflected at the collar from landing within the pattern of apertures on the mask. The Figure shows diagrammatically a part of the shadow mask 20 with bulged portion 23 and collar 24. The collar 24 has a length l and makes an angle $\beta$ with the longitudinal axis of the tube. The mask sheet makes an angle $\gamma$ with the axis perpendicular to the longitudinal axis 28 of the tube. An electron beam deflected over a maximum angle $\phi$ impinges on the collar 24 at an angle $\alpha_i$ and is reflected at the same angle $\alpha_i$. The electron beam reflected by the collar 24 impinges on the shadow mask at an angle $\theta$ with the plane of the mask sheet at a distance $\omega$ from the outside of the collar 24. If the distance from the outermost mask aperture 22 to the outside of the collar 24 is known, the maximum value which thedistance $\omega$ may have is also fixed. At a given collar length l and a given maximum deflection angle $\phi$, the angle $\beta$ of the collar 24 with the longitudinal axis 28 is determined by the relationship:

$$l \sin(\phi-\beta)=\omega \sin(90°+2\beta-\gamma-\phi).$$

For example, for a 110° display tube with $\phi=51.5°$, $l=8.6$ mm, $\omega=10$ mm and $\gamma=16°$ this leads to a minimum angle $\beta$ of 5°.

Figure 3A:
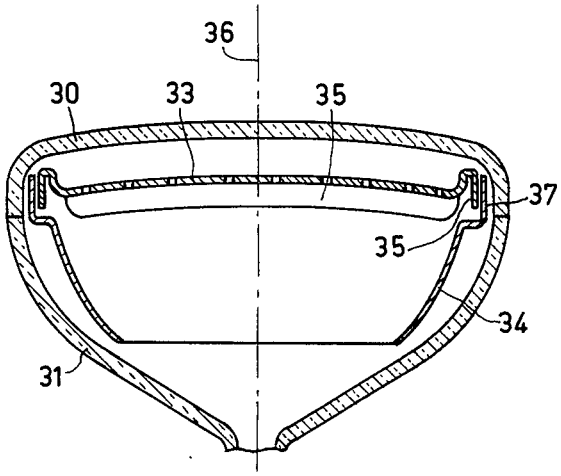

FIG. 3*a* is a diagrammatic drawing to explain the construction of the screening cap. The display window 30 and a part of the cone 31 are shown. Within the envelope the shadow mask 33 and the screening cap 34 are secured. The screening cap 34 serves to screen the electron paths from the earth's magnetic field, so as to maintain a good colour purity. The collars 35 of the shadow mask 33 make and angle of +5° with the longitudinal axis 36 of the tube. The edge 37 of the screening cap 34 follows the contour of the shadow mask 33 and thus makes an angle of −5° with the axis 36. In order to obtain good magnetic screening, the shadow mask 33 and the screening cap 34 should be short-circuited magnetically. As a result of the overlap of the shadow mask 33 and the screening cap 34, these are short-circuited magnetically without mechanical contact.

Figure 3B:
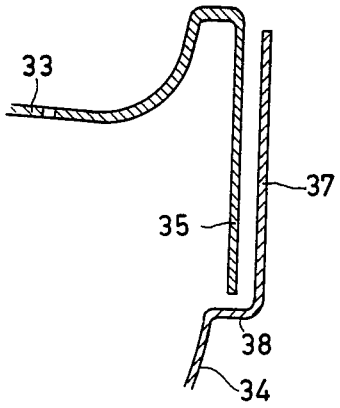

A detail hereof is shown in FIG. 3*b*. It has been found that a good screening is obtained if the overlap of the edge 37 of the screening cap 34 and the collar 35 of the shadow mask 33 is at least 10 times as large as the distance between the edge 37 and the collar 35. In order to prevent electrons between the edge 37 and the collar 35 from landing on the display screen by reflections, the screening cap comprises a shoulder 38 which covers the opening between the collar 35 and the edge 37.

Figure 3C:
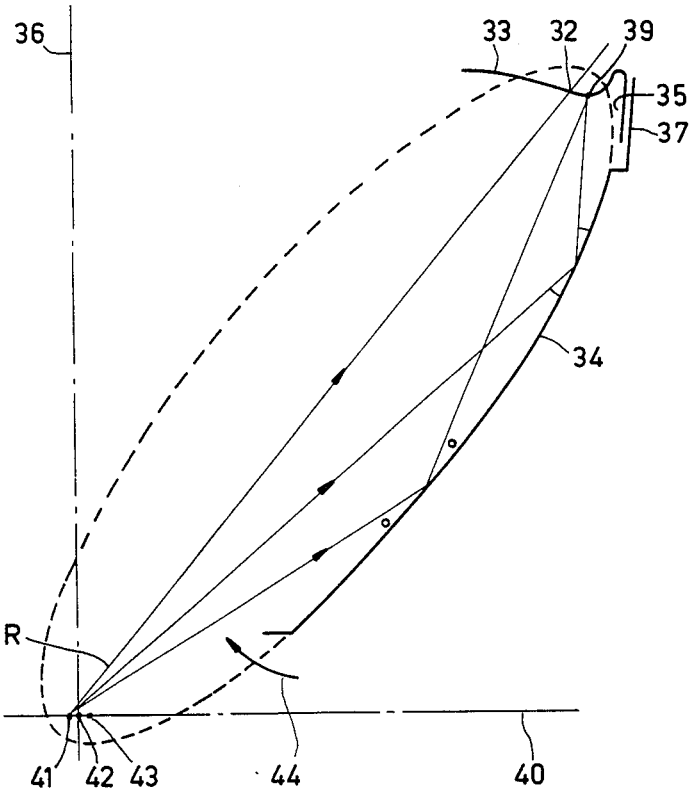

The collars make an angle of 5° with the longitudinal axis 36 of the display tube so as to ensure that the electrons reflected by the collars 35 land on the mask 33 beyond the pattern of apertures. It should also be ensured that electrons reflected by the screening cap 34 land on the mask 33 outside the pattern of apertures. For this purpose the screening cap should have a particular shape which will be explained with reference to FIG. 3*c*.

A part of the shadow mask 33 with outermost mask aperture 32 and the screening cap 34 are shown diagrammatically. Reference numeral 40 denotes the deflection plane in which the deflection points 41, 42 and 43 of the electron beams R, G and B, respectively, are situated after passing through the shadow mask 33, the beams impinge upon phosphor regions on the display screen luminescing in red, green and blue, respectively. Of the electron beams falling through the outermost mask aperture 32 the electron beam R makes the largest angle with the longitudinal axis 36 of the tube. Of the overdeflected electrons, the electrons of the electron beam R will consequently impinge on the screening cap 34 at the largest angle and after reflection impinge on the mask 33 at the largest distance from the collar 35. In order to ensure that these reflected electrons land on the mask 33 outside the last mask aperture 32, the screening cap 34 should have the shape of an ellipse, the foci of which are situated in the point 39 situated just beyond the pattern of holes and the deflection point 41 of the electron beam R. When the screening cap 34 is turned about the focus 39 in a direction denoted by the arrow 44, the electrons deflected at the screening cap 34 land on the mask 33 farther from the outermost mask aperture 32. The screening cap 34 may also be parallel to the position shown in FIG. 3*c* at a larger distance from the longitudinal axis 36 of the display tube.

Figure 4A:
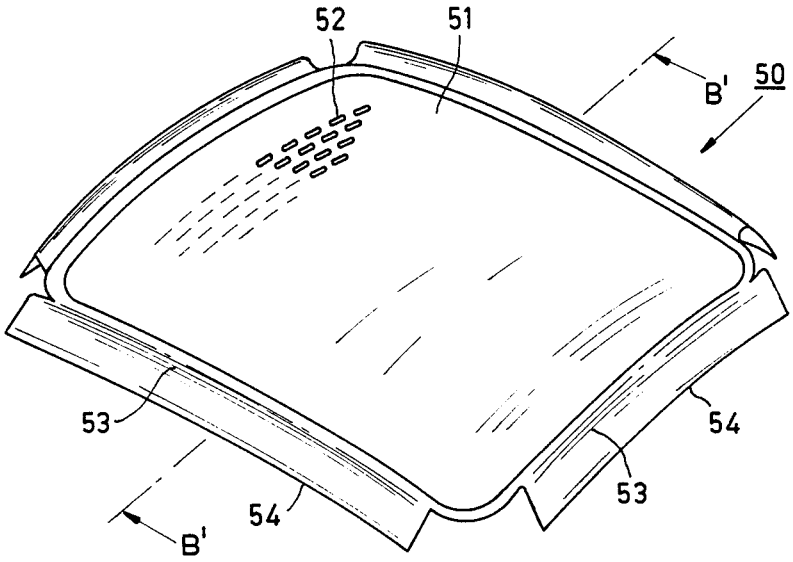
FIG. 4*a* is a perspective view of another embodiment of a shadow mask.

FIG. 4*a* is a perspective view of another embodiment of a shadow mask in accordance with the invention. Like the mask shown in FIG. 2, the shadow mask 50 is formed by a thin metal sheet the central portion 51 of which comprises a large numbr of apertures 52. A bulged portion 53 with collar 54 is provided in each of the four rectangular sides of the mask. The collars 54 are bent outwardly and make an angle of 25.5° with the longitudinal axis of the display tube.

Figure 4B:
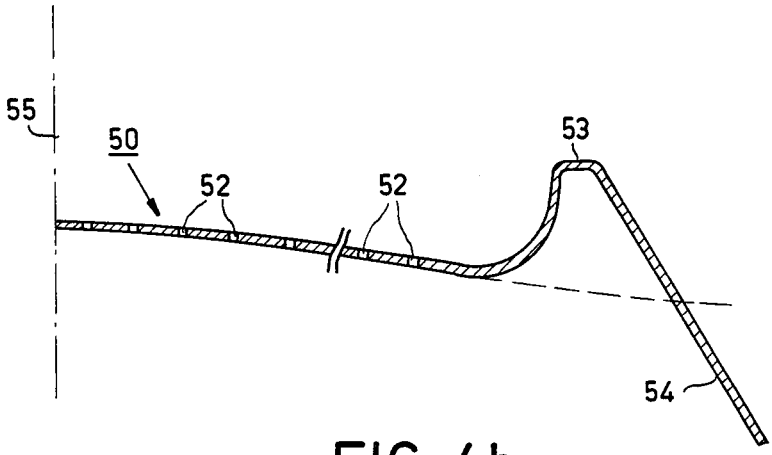
FIG. 4*b* is a sectional view along a part of the line B'B' of FIG. 4*a*.

FIG. 4*b* is a sectional view along a part of the line B'B' of FIG. 4*a*. The height of the bulged portion 53 is again 5 mm, the width 3.5 mm and the length of the collar 54 is 8.6 mm. For collars 54 bent outwardly it has been found that the maximum deflection angle in a direction along the line B'B' is decisive of the angle which the collars 54 should make with the longitudinal axis 55 of the display tube so as to prevent electrons reflected at the collars 54 from landing on the mask sheet. In the embodiment of a 110° display tube shown the maximum deflection angle of the electron beams along the line B'B' which impinge on the end of the collar is 39°. The collar 54 makes an angle of 25.5° with the longitudinal axis 55 of the display tube. Angles exceeding 25.5° are also possible, which will be explained in detail with reference to FIG. 4*c*. The electrons reflected at the collar 54 are reflected in a direction perpendicular to the longitudinal axis of the display tube and do not land on the mask sheet.

Figure 4C:
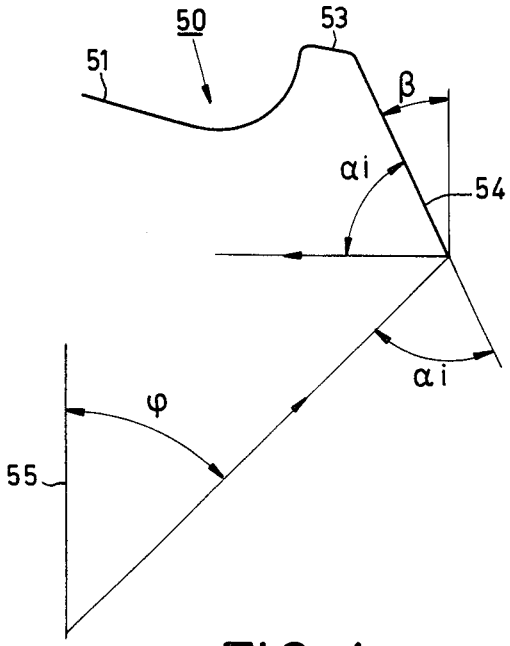
FIG. 4*c* is shows schematically the shape of the shadow mask of FIG. 4*a*.

FIG. 4*c* shows diagrammatically a part of the shadow mask 50 with bulged portion 53 and collar 54. The collar makes an angle $\beta$ with the longitudinal axis 55 of the display tube. An electron beam deflected over a maximum angle $\phi$ impinges on the end of the collar 54 at an angle $\alpha_i$ and is reflected at the same angle $\alpha_i$. The minimum angle $\beta$ which the collar 54 should make with the longitudinal axis 55 so as to prevent reflected electrons from landing on the shadow mask 50 is determined by the relationship:

$$\beta=\tfrac{1}{2}(90°-\Phi)$$

For example, for a 110° display tube with $\phi=39°$ this leads to a minimum angle $\beta$ of 25.5°.

Figure 4D:
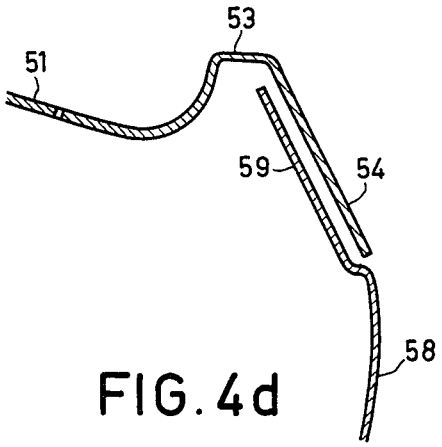
FIG. 4*d* shows the construction of the magnetic screening for the mask shown in FIG. 4*a*.

FIG. 4*d* shows diagrammatically a part of the magnetic screening cap 58. The edge 59 of the screening cap 58 extends parallel to the collar 54. The magnetic screening is optimum if the overlap of the edge 59 is at least 10 times as large as the distance between the edge 59 and the collar 54.

Figure 5A:
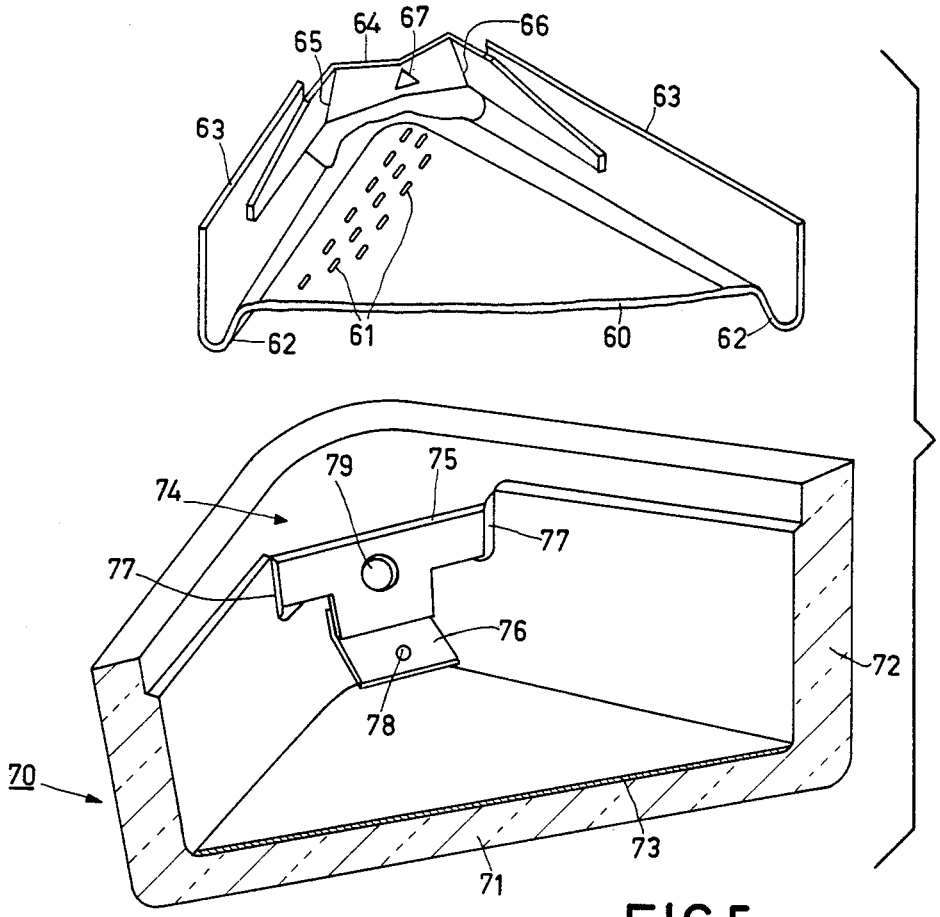
FIG. 5*a* is an exploded perspective view of an embodiment of a suspension of a shadow mask in a corner of the display window.

A shadow mask in accordance with the invention is formed from a comparatively flexible mask sheet and includes a mask frame in the form of four bulged portions with collars extending along the sides of the mask. The bulged portions are rigid in the direction perpendicular to the plane of the mask sheet. The mask sheet is rigid in its own plane. The shadow mask as a whole can easily be twisted about the diagonals and consequently has four hinge points at the corners of the shadow mask. The position of the shadow mask is fixed unambiguously with respect to the display window having an upright edge if eight and only eight degrees of freedom of the shadow mask are fixed. A first embodiment of a suspension of the shadow mask with which this is realized will be explained with reference to FIG. 5*a* which is an exploded perspective view of a suspension of the shadow mask in a corner of the display window. It is to be noted that this suspension forms the subject matter of a simultaneously filed patent application Ser. No. 270,444. The Figure shows the shadow mask 60 with a pattern of holes 61 and the bulged portions 62 with collars 63 provided along the sides. A brace 64 is connected to the collars 63 in the corner of the shadow mask 60. the brace 64 is folded about the lines 65 and 66 and has a hole 67 of triangular shape. The display window 70 comprises face plate 71 and an upright edge 72. The display screen 73 luminescing in three colours and covered by an aluminium coating is provided on the face plate 71. A chamber-like recess 74 is provided in the corner of the upright edge 72. A metal strip 75 having a flat metal spring 76 is connected in said recess 74. The strip 75 has an aperture 79 used for the connection of the magnetic screening cap in the tube, which will be explained in detail with reference to FIG. 6. The strip 75 is fixed in the corners of the chamber-like recess 74 by means of a glass enamel or a cement 77. The spring 76 is connected to the strip 75 at such an angle that the spring 76 is substantially perpendicular to the path of the electron beams towards the corner of the display window 70, so that during warm-up of the display tube the shadow mask will move towards the face plate 71, which is necessary to maintain good colour purity. A positioning member 78 is provided in the spring 76. In manufacturing the display tube the shadow mask 60 is placed at the correct distance from the face plate 71 by means of four spacing members placed in the corners. The braces 64 are clamped onto the springs 76 by means of temporary clamping members, the positioning member 78 falling in the hole 67. In this position the strips 75 are fixed by means of a glass enamel or a cement 77 in the chamber-like recesses 74. After providing the luminescent phosphor pattern on the display window 71, in which the shadow mask 60 is repeatedly removed and remounted, the positioning member 78 is permanently connected to the brace 64 by means of a number of laser welds or other contactless welds. As a result of this suspension construction the position of the shadow mask 60 relative to the display window 71 is unambiguously fixed. The distance from the four corner points to the display window and hence the distance from the shadow mask 60 to display window 71 is fixed unambiguously, with which four degrees of freedom are fixed. As a result of the connection of the positioning member 78 of the spring 76 to the brace 64, a movement of the corner points of the shadow mask 60 in a direction perpendicular to the diagonals in the plane of the shadow mask 60 is impossible, while all other directions of movement are possible. As a result of this four degrees of freedom are fixed and thus for the shadow mask 60 a total of eight degrees of freedom are fixed.

Figure 5B:
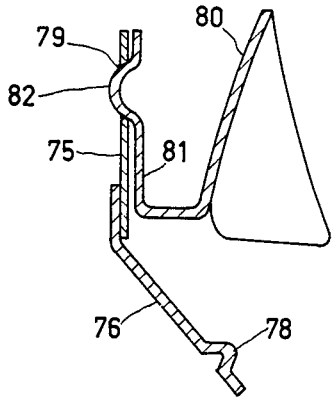
FIG. 5*b* shows diagrammatically the connection of the magnetic screening.

FIG. 5*b* shows diagrammatically the connection of the magnetic screening cap in the display tube in which for clarity non-essential components are not shown. The screening cap 80 comprises in each of the corners a bent-over strip 81 which has a part-spherical embossment 82. The strip 81 is placed against the strip 75 connected in the corner of the display window, the embossment 82 falling through the aperture 79 of the strip 75. In this position the embossment can be connected to the aperture 79, for example, by means of a cement.

Figure 6:
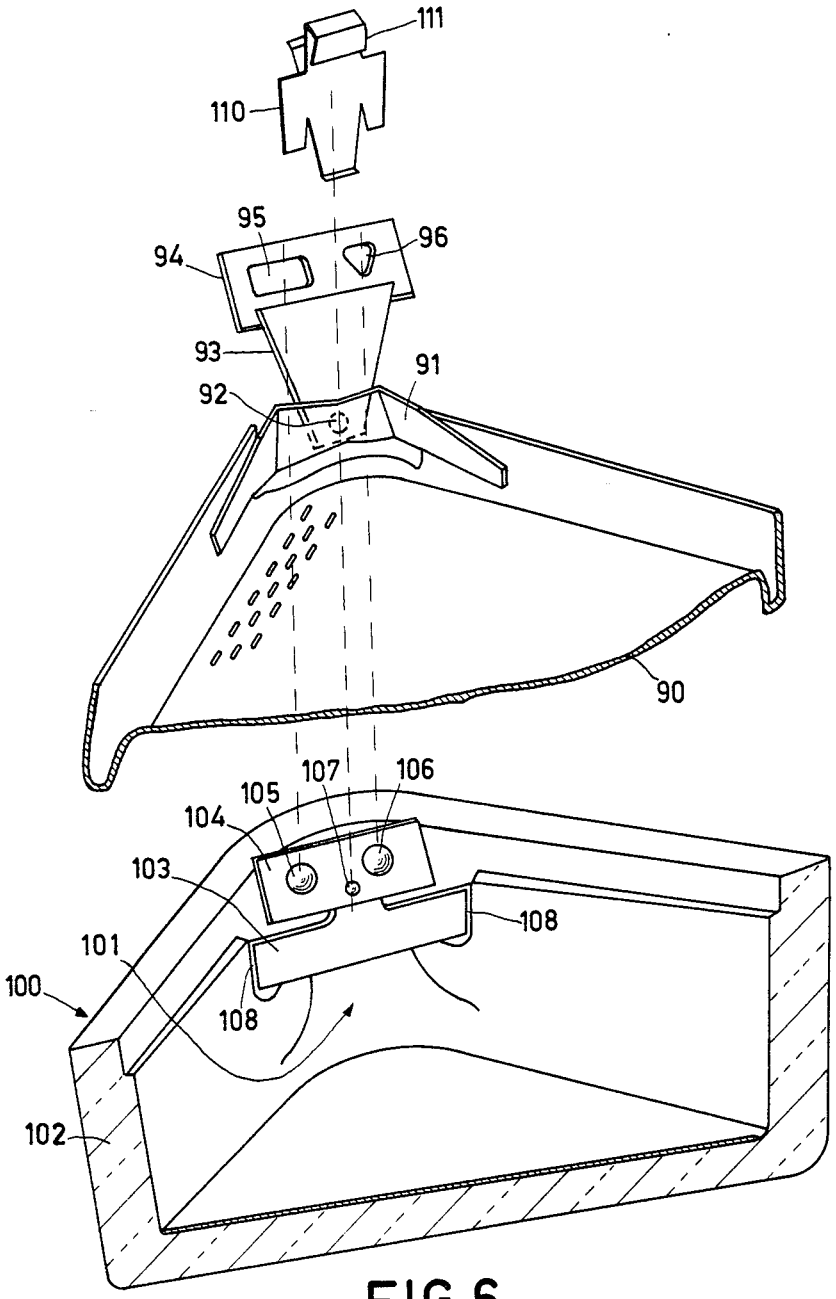
FIG. 6 is an exploded perspective view of another embodiment of a suspension of the shadow mask in a corner of the display tube.

FIG. 6 is an exploded perspective view of a second embodiment of a suspension of the shadow mask in a corner of the display window. It is to be noted that this suspension also in itself is the subject matter of a simultaneously filed patent application Ser. No. 270,285. In the corner of the shadow mask 90 again a brace 91 is connected. A flat spring 93 is connected to the brace 91 by means of a thin metal plate 92. A carrier plate 94 having a rectangular aperture 95 and a triangular aperture 96 is connected to the spring 93. A strip 103 is fixed in the chamber-like recess 101 in the edge 102 of the display window 100 by means of a glass enamel or a cement 108. A supporting plate 104 having three embossed portions 105, 106 and 107 is connected to the strip 103. The embossments 105 and 106 are larger than the embossment 107. The shadow mask 90 is connected in the display tube by placing the carrier plate 94 on the supporting plate 104. The carrier plate engages the embossed portion 107. The embossments 105 and 106 fall partly through the apertures 95 and 96, the embossment 105 engaging the aperture 95 at two points and the embossment 106 engaging the aperture 96 at three points. The supporting plate 104 and the carrier plate 94 are held together by a clamping member 110 the bent-over end 111 of which engages the carrier plate 94 in a point which corresponds to the centre of mass of the three embossments 105, 106 and 107. The shadow mask 90 can be detached from the display window 100 by removing the clamping member 110. As a result of the shape of the carrier plate 94 and the supporting plate 104 the shadow mask after repeated assembly and disassembly, as is necessary to provide the display screen, always assumes the same position. The distance from the four corner points of the shadow mask to the display window is thus fixed unambiguously so that four degrees of freedom are fixed. The substantially punctiform connection between the spring 93 and the brace 91 by means of the metal plate 92 ensures that the corner points of the shadow mask cannot move in a direction perpendicular to the diagonals of the shadow mask, while the remaining directions of movement are permitted. Thus a total of eight degrees of freedom of the shadow mask are fixed.

What is claimed is:

1. A color display tube comprising an envelope including a rectangular display window, a rectangular shadow mask sheet including an apertured portion, mounting means for attaching the sheet to the display window, and an electron gun system for directing a plurality of electron beams through the apertures to the display window, said mounting means comprising:

(a) peripheral sides of the shadow mask sheet, each side shaped such that it includes a bulged portion extending toward the display window and a terminating collar extending away from the display window, and such that the center of mass of each side, when viewed in a cross-section taken perpendicular to a longitudinal axis of the side, lies in a plane which is an extension of the apertured portion of the shadow mask sheet; and (b) attachment members attached to the collars substantially along said planes.

2. A colour display tube as in claim 1 where each collar is disposed at such an angle with a longitudinal axis of the display tube that electrons reflected by the collar impinge on the mask sheet outside the pattern of apertures.

3. A colour display tube as in claim 1 where the collar is disposed at such an angle with a longitudinal axis of the display tube that electrons reflected by the collar are reflected in a direction which is substantially perpendicular to the longitudinal axis of the tube, so that the electrons reflected by the collar do not impinge on the mask sheet.

4. A colour display tube as in claim 1, 2 or 3 including an internal conical magnetic screening cap having one end adjacent to the display window which overlaps the collar and extends substantially parallel to the collar.

5. A colour display tube as in claim 4 where said end of the screening cap overlaps the collar by a distance which is at least ten times as large as the distance between the screening cap and the collar.

6. A colour display tube as in claim 4 where the screening cap includes a shoulder which extends across a gap between the screening cap and the collar.

7. A colour display tube as in claim 4 where the magnetic screening cap, when viewed in cross-section along a plane in which the longitudinal axis of the display tube lies, forms part of an ellipse having a first focus point lying in the mask sheet just outside the pattern of apertures and a second focus point coinciding with a deflection point of the one of said electron beams which forms the largest angle with the longitudinal axis of the display tube when it is deflected toward said first focus point.

8. A colour display tube as in claim 7 where the screening cap is formed such that the cross-section is rotated about the first focus point to establish a predetermined location on the mask where electrons reflected by the screening cap impinge.

9. A colour display tube as in claim 7, where the screening cap is formed such that the distance between said cross-section and the longitudinal axis of the tube is selected to establish a predetermined location on the mask where electrons reflected by the screening cap impinge.

* * * * *